US005725617A

United States Patent [19]

Hagiwara et al.

[11] Patent Number: 5,725,617

[45] Date of Patent: Mar. 10, 1998

[54] ABRASIVE ARTICLES WITH ENCAPSULATED LUBRICANT

[75] Inventors: Hironori Hagiwara, Machida, Japan; Ikuko Yamato, Woodbury, Minn.

[73] Assignee: Minnesota Mining and Manufacturing Company, St. Paul, Minn.

[21] Appl. No.: 809,480

[22] PCT Filed: Oct. 6, 1995

[86] PCT No.: PCT/US95/12924

§ 371 Date: Mar. 21, 1997

§ 102(e) Date: Mar. 21, 1997

[87] PCT Pub. No.: WO96/11085

PCT Pub. Date: Apr. 18, 1996

[30] Foreign Application Priority Data

Oct. 7, 1994 [JP] Japan ..... 6-270427

[51] Int. Cl.[6] ..... B21D 3/34

[52] U.S. Cl. ..... 51/295; 51/298; 51/306

[58] Field of Search ..... 51/295, 298, 304–306

[56] References Cited

U.S. PATENT DOCUMENTS

| | | | |
|---|---|---|---|
| 3,431,689 | 3/1969 | Schnabel et al. | 451/532 |
| 3,502,453 | 3/1970 | Baratto | 51/295 |
| 4,111,667 | 9/1978 | Adams | 51/295 |
| 4,381,188 | 4/1983 | Waizer et al. | 51/298 |
| 4,543,106 | 9/1985 | Parekh | 51/295 |
| 5,306,319 | 4/1994 | Krishnan et al. | 51/298 |
| 5,380,347 | 1/1995 | Winston et al. | 51/293 |

FOREIGN PATENT DOCUMENTS

| | | | |
|---|---|---|---|
| 650808 | 10/1994 | European Pat. Off. | B24D 3/34 |
| 3112954 | 3/1981 | Germany | B24D 3/34 |
| 62-152679 | 7/1987 | Japan . | |
| 63-32761 | 3/1988 | Japan . | |
| 63-32762 | 3/1988 | Japan . | |
| 63-32763 | 3/1988 | Japan . | |
| 63052971 | 3/1988 | Japan | B24D 3/00 |
| 4016885 | 1/1992 | Japan | G03G 15/20 |
| 95260437 | 6/1995 | Japan | B24D 3/32 |
| 95/24992 | 9/1995 | WIPO | B24D 3/14 |

*Primary Examiner*—Deborah Jones
*Attorney, Agent, or Firm*—Gary L. Griswold; Walter N. Kirn; Daniel R. Pastirik

[57] ABSTRACT

Abrasive articles having an encapsulated lubricant are described. In one aspect, the articles are characterized by a base substrate comprising a plurality of polymeric fibers adhered to one another at mutual contact points, the substrate having a base weight within the range from 20 to 10,000 g/m$^2$, abrasive grains adhered to the substrate and a plurality of lubricant capsules adhered to the substrate the capsules comprising a continuous shell with lubricant therein, and the shell comprising a cured thermosetting resin. In another aspect, a composite abrasive article is characterized by at least two layers of the aforementioned abrasive article compressed together and adhered by a binder, the composite article having a flexural modulus of not more than 100 kgf/cm$^2$.

19 Claims, No Drawings

ABRASIVE ARTICLES WITH ENCAPSULATED LUBRICANT

The present invention relates to abrasive articles. In particular, the present invention relates to abrasive articles containing an encapsulated lubricant therein.

The treatment of surfaces in surface finishing operations, for example, can be accomplished using any of a variety of surface treating articles to accomplish the desired treatment. The use of nonwoven articles in such applications is known. When nonwovens are used in the treatment (e.g., finishing) of metallic surfaces, a liquid or solid lubricant is applied to the nonwoven to improve the abrasive power of the article and to prevent "abrasive burning" or discoloration of the treated surface caused by the heat generated during the surface treating operation. The application of lubricant to the nonwoven or to the surface can be accomplished in several ways. For example, a lubricant can be applied directly to the nonwoven or to the surface being treated at various intervals during the finishing operation. Such an application of the lubricant, however, is unsatisfactory because the lubricant can splatter during the operation, especially under the operation of high speed surface treating equipment. Additionally, the lubricant must be applied frequently to maintain a desired level of lubrication.

It is desirable, therefore, to provide an article which can be used in the surface treatment of metallic surfaces and the like wherein the article can be used, without the separate application of lubricant. Preferably, it is desirable to provide a surface treating article comprising a nonwoven substrate having a source of lubricant incorporated within the substrate so that the lubricant will automatically become available during the use of the article in surface treating operations.

The literature describes a variety of surface treating articles which include encapsulated lubricants and the like. Japanese Patent Laid-Open Publication No. Sho 62-152679 discloses abrasive materials including a lubricant encapsulated in an envelope made of inorganic substances. The disclosed envelope is porous with pore sizes of several tens to several hundred angstrom, so that a liquid lubricant may not be completely sealed in the capsule ("Recent Microcapsulation Technology" p. 131, edited by Integrated Technology Center).

Japanese Utility Model Laid-Open Publication Nos. Sho 63-32761 and 63-32762 disclose nonwoven abrasive materials including a lubricant encapsulated in an envelope of acrylic resin. The acrylic resin has a low glass transition temperature, requiring the use of a crosslinking and shows poor solvent and heat resistance because of a low crosslinking density. Consequently, the acrylic resin envelope may easily be dissolved by an organic solvent or melted by heat normally used in the manufacture of the nonwoven abrasive materials.

Japanese Utility Model Laid-Open Publication No. Sho 63-32763 discloses nonwoven abrasive materials with a lubricant encapsulated in glass capsules. The glass capsules are produced by heat-fusing a glass at a temperature higher than its melting point, potentially causing the lubricant to decompose during the preparation of the capsules. Additionally, the use of glass presents a potential safety hazard.

U.S. Pat. No. 3,502,453 (Baratto) discloses a resin bonded wheel comprising thermosetting resin capsules containing a lubricant to reduce grinding friction. The wheel, however, is not suitable for precision abrasion operations because of its relative inflexibility. Additionally, the lubricant containing capsules may not break in a uniform manner, thereby lowering the efficacy of the lubricant in various applications.

Accordingly it is desirable to provide a deformable surface treating article having an encapsulated lubricant which provides satisfactory lubricity during surface treating operations without the need for additional lubricants and without exhibiting the aforementioned problems inherent in the various prior an articles. Preferably, such a deformable surface treating article comprises a nonwoven substrate with the aforementioned encapsulated lubricant affixed thereto wherein the lubricant is effective in preventing abrasive burning during use and wherein the article exhibits excellent abrasive power.

The present invention provides an abrasive article with an encapsulated lubricant. The articles of the invention exhibit excellent abrasive power while avoiding abrasive burning during surface treating operations.

In one aspect, the invention provides an abrasive article, characterized by:

- a base substrate comprising a plurality of polymeric fibers adhered to one another at mutual contact points, said substrate having a base weight within the range from 20 to 10,000 g/m$^2$;
- abrasive grains adhered to said substrate; and
- a plurality of lubricant capsules comprising a continuous shell adhered to said substrate and containing lubricant therein, said shell comprising a cured thermosetting resin.

The fibers of the substrate preferably are staple fibers having a preferred length of about 10 to 50 mm and a denier within the range of 5 to 30. The fibers may comprise any of a variety elastic, conformable and durable materials. Preferred fibers comprise nylon 6,6. The substrate is preferably a nonwoven substrate with a void volume within the range of about 40 to 99%. As mentioned, the articles include an encapsulated lubricant wherein the lubricant is contained within a shell comprising a cured thermosetting resin. The preferred resin is highly resistant to degradation by heat and by solvents and suitable resins may be selected from epoxy resins, urea resins, melamine resins, phenol resins and polyamide resins. Preferably, the resin is a urea or a melamine resin. The capsules may also comprise an additional film layer surrounding the thermosetting resin to further enhance solvent and/or heat resistance. The film comprises a metal or an oxide thereof wherein the metal may be copper, nickel, zinc, silver, lead or tin.

As used herein, certain terms and phrases will be understood to have the meaning set forth herein. "Void volume" means the volume of open space within an article (expressed as a percentage) and determined according to the following equation:

$$\text{Void Volume (\%)}=[1-(\text{density of nonwoven/density of underlying fibers})]\times 100$$

"Thermosetting resin" means a polymeric resin capable of crosslinking. "Fibers" refers to threadlike structures comprising the materials as set forth herein. "Staple fibers" means fibers of a discrete length as further described herein. "Lubricant capsule" refers to an encapsulated lubricant comprising a continuous shell of one or more polymeric materials as described herein and containing a volume of lubricant therewithin. "Glass transition point" or "Tg" means the temperature at which a material changes from a vitreous state to a plastic state as measured on a model "DSC 4" differential scanning calorimeter available from the Perkin-Elmer Corporation. "Nominal Density" of a nonwoven article means the basic weight of a nonwoven article per its thickness according to the formula $$\text{Nominal density } (g/cm^3)=[\text{basic weight } (g/m^2)\times 10^{-4}/\text{thickness } (cm)].$$

In another aspect, the invention provides a composite abrasive article comprising at least two layers of the nonwoven abrasive article as described above compressed together and adhered by a binder, the composite article having a flexural modulus of not more than 100 $kgf/cm^2$.

The further details of the invention will be more fully appreciated by those skilled in the art upon consideration of the remainder of the disclosure.

The articles of the invention include a base substrate onto which the additional components of the article are adhered. The preferred base substrate is a nonwoven fabric comprising a plurality of polymeric fibers. The preferred substrate is one which is readily conformable to the surface of a desired workpiece and wherein the abrasive grains easily adhered to its fibrous surface. Preferably, such a substrate is inexpensive and lightweight. Although continuous filaments may be used in the manufacture of the substrate, the preferred substrate comprises a plurality of staple fibers having a length within the range of 10 to 50 mm and linear density within the range of 5 to 30 denier.

The fibers of the substrate may comprise any of a variety of materials suitable for the manufacture of fibers. Exemplary materials are polymeric materials such as, for example, polyamide, polyester, polypropylene, polyethylene, polysulfone, acrylic and poly (vinyl chloride) and the like. The fibers of the substrate may be a blend of fibers comprising any one or more of the foregoing materials. Additionally, substrates made with fibers comprising copolymers of the foregoing materials may be incorporated within the substrate, and blends of fiber deniers and fiber lengths are also contemplated within the scope of the invention.

Those skilled in the art will appreciate that preferred materials for the substrate may vary depending on the properties desired. Polyester fibers, for example, are preferred because of their excellent mechanical strength as well as their heat and wear resistance. Polyamide fibers (e.g., nylon 6,6) are most preferred because of their heat resistance, elasticity and conformability. Moreover, conventional resins employed in the manufacture of nonwoven abrasives, especially phenolic resins, adhere well to nylon 6,6 fibers.

The nonwoven base substrate preferably has a void volume within the range of 40% to 99%. At void volumes less than 40%, it becomes difficult to achieve effective penetration of abrasive grain and binder into the substrate during the manufacture of the article. At a void volume greater than 99%, the mechanical strength and wear resistance of the resulting abrasive materials may be unacceptable for certain applications. The void volume of the nonwoven substrate is expressed as a percentage according to the following equation:

$$\text{Void Volume } (\%)=[1-(\text{density of nonwoven/density of underlying fibers})]\times 100$$

Preferably, the thickness of the nonwoven fabric is within a range of 1 to 50 mm. If the thickness of the substrate is less than 1 mm, the mechanical strength of the resulting article may be poor. If the thickness is greater than 50 mm, it becomes increasingly more difficult to apply abrasive grains and resin binders inside the nonwoven substrate. Because of ease of preparation and the resulting uniformity of the finished articles, a nonwoven substrate having a thickness of 2 to 10 mm is most preferred.

A binder is employed to adhere the fibers of the nonwoven base substrate to one another at their mutual contact points and to adhere abrasive grain and encapsulated lubricant, discussed below, to the fibers of the substrate. Any of a variety of binders can be used in the manufacture of the articles of the invention. Epoxy resins are useful in the manufacture of the articles of the invention because of their high reactivity and mechanical strength. Commercially available epoxy resins include those available under the trade designations "DER-331" and "DER-332" from Dow Chemical Co. Urethane resins, because of their high reactivity and bonding strength, are also suitable for use in the articles of the invention. Suitable commercial urethanes include those available under the trade designations "UP-310" and "UP-340" available from Asahi Denka K.K. of Japan. Additionally, water-soluble urethane resins and a water-soluble epoxy resin may be used such as those disclosed by Krishnan et al. in U.S. Pat. No. 5,306,319.

Most preferably, the finished articles of the invention will have a flexural modulus of not more than 100 $kgf/cm^2$, and the preferred binders are those capable which can provide such articles. In this regard, phenolic resins are most preferred. Additionally, phenolic resins exhibit excellent heat resistance, abrasion resistance and mechanical strength. Commercially available phenolic resins suitable for use in the invention include those available under the trade designations "Shonol BRL-105" and "Shonol BRL-107" available from Showa Kobunshi K.K. of Japan.

Abrasive grains may be used in the articles of the invention. The grains used herein may be selected from any of a variety of grains available to those in the art. If the article is to be used in more aggressive abrasive applications, grains comprised of harder materials may be used such as conventional whetstone grains including silicon carbide, aluminum oxide, chromium oxide, emery and flint either alone or in combination with one another. Of the foregoing materials, those having a JIS No. of 36 to 10000 (an average grain size of 500-0.6 μm) are particularly preferred for precision abrasion applications. Of course, the invention is not limited to the use of the foregoing grains, and those skilled in the art will appreciate that other materials can be used in the articles described herein including those comprised of softer materials for less aggressive grinding. Additionally, the articles of the invention may be made without abrasive grain for applications wherein the binder coated substrate may have the required hardness such as in polishing applications, for example.

Abrasive grains may be employed in an amount within the range of 10 to 1000 parts by weight, and preferably 30 to 500 parts by weight based on 100 parts by weight of the base substrate. Although the weight of the grains used may also be outside of the foregoing ranges, the use of grain in an amount less than 10 parts by weight will typically decrease the abrasive power of the article below acceptable limits for some applications. Similarly, if the amount of grain in the article is greater than 1000 parts by weight, the abrasive grains may not bond properly to the fibers of the substrate, resulting in the loss of a significant portion of the grains during use.

The articles of the invention include a lubricant capsule bonded to the fibers of the substrate by the aforementioned binder. The lubricant capsule comprises an envelope in the form of a continuous shell and a core substance comprising a lubricant contained within the envelope. The preferred lubricant capsule for use in the invention is prepared to have solvent resistance as well as heat resistance. The envelope of the lubricant capsules of the present invention preferably will have a glass transition point (Tg) sufficiently high to avoid softening during the manufacture of the nonwoven abrasive materials while allowing a softening of the capsule during an abrasive application of the finished article to thereby release the encapsulated lubricant during use. In general, a glass transition point of at least 160° C. is preferred because of the temperatures employed in the drying step used in the preparation of nonwoven abrasive. Materials having a glass transition point of more than 180° C. are preferred for abrasive materials to be used in high speed.

Preferably, the lubricant capsule comprises a crosslinked polymer because of the ability of such materials to satisfy the aforementioned solvent resistance requirements. Examples of suitable crosslinked polymers include: epoxy resin, urea resin (e.g., urea-formaldehyde resin, urea-acetaldehyde resin, urea-propionaldehyde resin, and urea-butylaldehyde resin), melamine resin (e.g., melamine-formaldehyde resin, melamine-acetaldehyde resin, melamine-propionaldehyde resin and melamine-butylaldehyde resin), phenol resin (e.g., phenol-formaldehyde resin, phenol-acetaldehyde resin, phenol-propionaldehyde resin, phenol-butylaldehyde resin, xylenol-formaldehyde resin, xylenol-acetaldehyde resin, xylenol-propionaldehyde resin and xylenol-butylaldehyde resin), and polyamide resin.

The preferred materials for the manufacture of the continuous shell of the lubricant capsule comprises a polymeric component and a suitable crosslinking material. Preferably, the mole ratio between the polymeric component such as urea, melamine and phenol and the like and the crosslinking component (e.g., formaldehyde) is within the range from 1:1.2 to 1:1.7. Ratios within this range will provide a satisfactory reactivity and low mount of residual unreacted crosslinking material. Among the above exemplified resins, a urea resin and a melamine resin are particularly preferred due to their excellent solvent resistance. The most preferred resin in making the capsules is a urea resin.

Suitable lubricants for inclusion in the lubricant capsules include petroleum-derived lubricants (e.g., paraffin wax), synthetic resin lubricants (e.g., silicone oil, olefin polymerized oil, diester oil, polyoxyalkylene glycol, and halogenated hydrocarbon oil, etc.), and fatty acids (e.g., stearic acid and myristic acid, etc.).

Lubricant capsules may be included in the nonwoven articles of the invention in an amount of 1 to 100 parts by weight based on 100 parts by weight of nonwoven fabric. If the amount of lubricant capsules is less than 1 part by weight, satisfactory lubricity may not be provided. If the amount of lubricant capsules exceeds 100 parts by weight, the amount of abrasive grain which is able to adhere to the base substrate may decrease with a corresponding decrease in the abrasive power of the finished article. To balance the abrasive power and lubricity, the amount of lubricant capsules in the finished article is preferably within the range of 5 to 50 parts by weight and more preferably within the range of 10 to 30 parts.

The lubricant capsules employed in the present invention may be prepared by the following procedure:

A suitable lubricant is fed into an aqueous solution of a resin. The temperature and the stirring speed of the mixture is controlled in a known manner so that the lubricant may form droplets of appropriate size. Thereafter, the crosslinking reaction of the resin is initiated to yield capsules containing lubricant therein. In a preferred lubricant capsule, formalin, urea and a pH adjuster are placed in a suitable reaction vessel and the temperature of the mixture is controlled within the range 25° to 90° C. The mixture is stirred for 1 to 24 hours to give a water-soluble urea-formaldehyde resin. The temperature of the resin solution is then adjusted to exceed the melting point of the lubricant (e.g., 60° to 90° C.), and the lubricant is added with stirring and thereby melted. Acid having pH of 3 to 6 (e.g., citric acid) is added to catalyze the polymerization reaction, followed by constant stirring for 1 to 10 hours at a stirring rate of 300 to 5000 rpm to thereby form lubricant capsules suitable for use in the articles of the present invention.

A preferred curing catalyst for use in the above reactive procedure is a weak acid, preferably those having a pH within the range of 3 to 6. In the foregoing pH range, the condensation reaction will proceed faster than the addition reaction of formalin to urea, so that crosslinking reaction is carried out most efficiently. As a result, the envelope of the capsules will have a high crosslinking density and improved solvent and heat resistance. Additionally, a weak acid can be handled more safely than a strong acid, and any weak acid remaining on the lubricant capsule will present less of a hazard to the workpiece than the stronger acids might. Citric acid, boric acid, malic acid, phosphoric acid and the like are suitable for use as the curing catalyst.

In another aspect of the invention, the outer surfaces of the lubricant capsules are optionally coated with a thin metal or metallic oxide film to further improve the solvent resistance and abrasive power of the finished abrasive articles. The metallic coatings useful in the present invention comprise thin coatings of metals or metallic oxides of nickel, copper, zinc, silver, lead or tin. The coatings may be applied to the lubricant capsules in a known manner by conventional vacuum evaporation, sputtering or by chemical plating, for example.

Lubricant capsules of a size less than the space between fibers of the base substrate may be used. In metal finishing applications, the linear density of the fibers used in the nonwoven base substrate will preferably be within the range of 5 to 30 denier. In these articles, a preferred grain size for the lubricant capsules is 5 to 300 μm. When the grain size of the capsules is less than 5 μm, the capsules will be more difficult to rupture during an abrasive application. When the grain size of the lubricant capsules is greater than 300 μm, the capsules may interfere with the ability of the abrasive grains and the binder to effectively enter the inner areas of the nonwoven base substrate. In order to allow for the homogeneous dispersion of the lubricant capsules into the nonwoven fabric, a grain size of 20 to 150 μm is preferred, and in order to allow for the uniform destruction of the lubricant capsules during an application of the finished articles, a grain size within the range of 10 to 20 μm is more preferred.

The continuous shell or envelope of the lubricant capsules preferably has a thickness within the range from 0.5 to 20 μm. At a thickness less than 0.5 μm, heat and solvent resistance may be poor. If the thickness is beyond 20 μm, the capsules may be too hard to break during an abrasive application. To allow for the uniform destruction of capsules during use, a thickness within the range of 1 to 10 μm is preferred, and a thickness in the range of 2 to 7 μm is more preferred.

The abrasive articles of the invention can be prepared in the following procedure.

A prebonded nonwoven base substrate comprising polyamide fibers and the like is treated with a mixture containing abrasive grain, binder (e.g., phenolic resin), solvents (e.g., ethylene glycol monoethyl ether acetate) and lubricant capsules. The foregoing mixture may be applied in a known manner using an immersion method, a two-roll coater or by spraying. Since the mixture will contain an organic solvent, lubricant capsules which are solvent resistant are preferred. Alternatively, commercially available nonwoven abrasive materials may be used, and a mixture of lubricant capsules in a suitable binder may be applied to the nonwoven. Suitable commercial abrasive materials include those made of conventional nonwoven materials comprising polyamide fibers or polyester fibers with abrasive grains adhered to the fibers with a suitable binder. Preferred are those article having abrasive particles of JIS No. 36 to 10000 such as silicon carbide, aluminum oxide, chromium oxide, emery and flint. Exemplary of this kind of nonwoven abrasive material is are those available under the trade designation "Scotch-Brite" from the Minnesota Mining and Manufacturing Company of St. Paul, Minn., USA After applying the lubricant capsule and binder, the article is heated in an oven at about 160° C. for about 15 minutes to dry the organic solvent and to solidify a binder.

The thus obtained open, lofty nonwoven abrasive article will preferably have a basic weight within the range of 20 to 10,000 g/m$^2$ with enough flexibility to conform to the contours along the surface of a workpiece. Preferably, the basic weight of the article will be within the range of 40 to 6000 g/m$^2$ and more preferably 100 to 5000 g/m$^2$. The article of the invention will have a nominal density within the range of about 0.01 to 1.00 g/cm$^3$, preferably 0.02 to 0.60 g/cm$^3$, more preferably 0.05 to 0.50 g/cm$^3$.

In another aspect of the invention, the above described articles may be further processed into bonded wheels in a known manner. Convolute wheels, for example, may be provided by taking a single continuous sheet of the above described nonwoven article and shaping it into a roll or disk by coiling the article over a core. Alternatively, unitized wheels can be provided by cutting the above provided nonwoven abrasive articles into a plurality of individual pieces (e.g., squares). The individual pieces are stacked one upon another, compressed and laminated together by the application of pressure and heat. In compressing the sheets of nonwoven articles, the nonwoven abrasive materials are preferably compressed to a density 1 to 20 times that of the density of the materials in its uncompressed state and subjected to heat molding for 4 hours at an elevated temperature, usually at 135° C. The thus treated laminates can then be cooled and cut into to provide a bonded wheel. Additionally, The nonwoven abrasive articles of the invention can be used in the manufacture of flap brushes.

Alternatively, the aforementioned bonded wheel or brush can be prepared by using a mixture containing lubricant capsules, binders and organic solvents, in place of the binders alone in the above stated procedure. In this procedure, the lubricant capsules must be made of a material having solvent resistance as well as heat resistance.

The present nonwoven abrasive materials made according to the above-mentioned procedure generally have a flexural modulus of not more than 1,000 kgf/cm$^2$, preferably 1 to 500 kgf/cm$^2$, more preferably 10 to 500 kgf/cm$^2$. The abrasive material having such a range of basic weight shows flexibility so as to deform readily along with the working surface of the workpiece to be abraded. In this manner, the articles of the invention allow for the precise and uniform abrasive treatment of complex surfaces.

PREPARATIVE PROCEDURES

Preparation of Pre-Bonded Web

A raw nonwoven fabric having a basic weight of 100 g/m$^2$ was prepared by the use of a 15 denier nylon having a fiber length of 38 mm on a web forming machine, followed by fiber fixation by the use of a phenolic resin ("Shonol BRL-107" from Showa Koubunshi K.K. of Japan). The web was then heated for 15° minutes at 140° C. and cooled to a non-tacky condition to provide a pre-bonded substrate having a basic weight of 150 g/m$^2$.

Preparation of the Lubricant Capsules 32 parts of formalin and 12 parts of urea were heated in a reaction vessel at 70° C. for 2.5 hours. 50 parts of distilled water was added to yield a water-soluble urea resin. 4290 ml of thus obtained aqueous resin, 1420 ml of distilled water and 571 g sodium sulfate were mixed together and heated to 90° C. with stirring. When the temperature of the mixture reached 90° C., 1800 g of stearic acid was added under constant stirring and the pH was adjusted to about 5.0. After stirring for 5 hours, the mixture was neutralized with aqueous sodium hydroxide, and the resulting lubricant capsules were separated by filtration, rinsed with distilled water and filtered a second time. The average size of the resulting capsules was 130 μm.

Preparation of Metallized Capsules

A portion of the capsules prepared according to the above described preparative procedure was further coated with an aluminum using aluminum foil and a metal evaporating machine (model "JEE-4X" manufactured by Nippon Denshi K.K., Japan). The aluminum was applied to the capsules to have a thickness of about 100 to 1000 angstroms. In the evaporating procedure, the aluminum foil was heated to a temperature of 100° C. under a pressure of 1–2×10$^5$ Torr, and the resulting aluminum vapor was deposited onto a surface of the capsules over a time of 10 to 30 seconds.

Preparation of Nonwoven Abrasive Materials 100 parts of ethylene glycol monoethyl ether acetate, 150 parts of abrasive grains of silicon carbide of JIS No. 2000, and 80 parts of the above prepared stearic acid capsules, each based on 100 parts of phenol resin, were mixed together. The resulting mixture was spray coated to a pre-bonded web prepared as in the above preparative procedure. The thus treated substrate was cured in a through-oven at 160° C. for 15 minutes to obtain open, lofty nonwoven abrasive materials having a basic weight of 600 g/m$^2$, a thickness of 5 mm and a density of 0.12 g/cm$^3$.

Preparation of Unitized Wheel

Nonwoven abrasive materials made according to the foregoing preparative procedure were cut in a disk shape and the disks were laminated together using a polyether urethane resin and compressed under a pressure of 1 kgf/cm$^2$ and a density of 12 sheets per inch (2.54 cm). The article was then cured in a batch oven at a temperature of 135° C. for 4 hours to provide an abrasive article in the form of a bonded wheel. The flexural modulus of the resulting wheel was 200 kgf/cm$^2$.

EXAMPLES

The invention is further illustrated in the following non-limiting Examples wherein, all parts are by weight unless otherwise specified.

Example 1

Lubricant capsules were prepared according to the above preparative procedure. The resulting capsules were evaluated to determine their solvent resistance and heat resistance, as reported below.

Example 2

Metalized capsules were prepared according to the above preparative procedure. The capsules were evaluated to determine their solvent resistance and heat resistance, as reported below.

COMPARATIVE EXAMPLE A

For use as a Comparative Example, acrylic resin capsules were purchased from Matsumoto-Yasui Co. Ltd. of Japan The capsules were evaluated to determine their solvent resistance and heat resistance, as reported below.

Examples 1 and 2 and Comparative Example A

The solvent resistance of the capsules of Examples 1 and 2 and Comparative Example A were tested by immersing a portion of the capsules in ethylene glycol monoethyl ether acetate. The acrylic capsules dissolved immediately, showing no resistance to the solvent. After a six month period in the solvent, the capsules of Examples 1 and 2 were removed and examined by microscopy. Inspection of the inventive capsules indicated excellent solvent resistance. In general, these capsules did not appear to be significantly eroded by the long exposure to solvent. The metalized capsules of Example 2 were evaluated as having slightly better solvent resistance than the capsules of Example 1.

To test the heat resistance of the capsules of Examples 1 and 2, another portion of the capsules were heated to 160° C. for 24 hours and examined at the end of the 24 hour period. Examination of these capsules revealed no damage by exposure to high temperature. Additionally, a portion of the capsules of Comparative Example A were heated to 130° C. These acrylic capsules melted immediately, showing no heat resistance.

Example 3

A bonded wheel was prepared according to the above preparative procedure.

The wheel of Example 3 was examined by microscopy to inspect the condition of the lubricant capsules contained within the wheel. No change was observed in the lubricant capsules in the final product, indicating that the lubricant capsules were able to withstand exposure to the solvents and the heat associated with the manufacture of a bonded wheel.

COMPARATIVE EXAMPLE B

A commercially available MG wheel 5S-2010 available from by Sumitomo 3M of Japan was selected as a control in the abrasion testing described below. The MG wheel 5S-2010 comprises a nonwoven abrasive prepared by impregnating nonwoven web made of a 15 denier nylon fiber having a length of 38 mm with a slurry comprised of abrasive grains and a phenol resin, and pressing a stack made of several sheets of the resulting web having a thickness of 5 mm under a pressure of 1 kgf/cm$^2$ by the use of a polyether urethane resin. Comparative Example B included no lubricant capsules.

COMPARATIVE EXAMPLE C

A commercially available MG wheel 5S-2010 was obtained as in Comparative Example B. The grinding surface of the wheel was coated with a lubricating grease and the thus coated wheel was used in the comparative testing set forth below.

Example 3 and Comparative Examples B and C (a) Evaluation of abrasive ability

A continuous abrasion test was conducted for the articles of Example 3 and Comparative Examples B and C using a centerless abrasion machine (by Nisshinbo Industries, Inc., Japan) under the conditions given below. A time dependent determination of the abrasive power was made for the tested articles. The amount of cut (mg) was determined from the weight difference between pre- and post-abrasion of the steel rod used in the test, which difference was determined at the time intervals indicated in Table 1

The abrasion test conditions were:

| | |
|---|---|
| Steel rod[1] | 10 mm dia × 150 mm length |
| Feed rate | 2 m/min |
| Load | 3 amp/25 mm/200 V |
| Abrasion time | 45 sec |

[1]S45C carbon steel (0.43 to o.48 wt % carbon)

TABLE 1

| | Cut (mg) | | | | | | |
|---|---|---|---|---|---|---|---|
| Time | 0 min | 5 min | 10 min | 30 min | 60 min | 120 min | 180 min |
| Ex. 3 | 143.7 | — | 150.1 | 158.3 | 149.9 | 147.8 | 160.9 |
| C.Ex. B | 35.4 | — | 12.1 | 14.6 | 8,3 | 14.6 | 10.4 |
| C.Ex.C | 66.6 | 18.7 | 12.5 | 10.4 | — | — | — |

As shown in the data, the wheel of Example 3 was capable of providing an improved initial lubricative effect compared to the wheels of the Comparative Examples and also was able to maintain its improved abrasive power over the duration of the testing procedure without the need for additional lubricant. The wheels of the Comparative Examples did not perform as well as the wheel of inventive Example 3 at any of the time intervals. The wheel of Comparative B showed a decrease in abrasive power after the initial measurement with the cut leveling off to be fairly constant thereafter. The wheel of Comparative Example C exhibited good initial cut which soon diminished.

(b) Evaluation of abrasive burning

Using the same equipment as in the above evaluation of the abrasive ability of the wheels, resistance to abrasive burning was evaluated for the wheels of Example 3 and Comparative Example B under the following conditions:

| | |
|---|---|
| Steel rod[1] | 10 mm dia × 150 mm length |
| Feed rate | 0 |
| Load | 5 amp/25 mm/200 V |
| Abrasion time | 30 sec |

[1]S45C carbon steel (0.43 to o.48 wt % carbon)

After the above time period, the rod was visually inspected for abrasive burning. The steel rod used in the test of Comparative B showed significant burning whereas no abrasive burning was observed on the surface of the steel rod abraded the wheel of Example 3, indicating that sufficient lubricative effect was provided by the present invention.

As the above test results demonstrate, the lubricant capsules of the present invention clearly provide sufficient solvent and heat resistance to endure the solvent and heat employed in the preparation process for nonwoven abrasive articles. When the articles of the invention are employed in abrasive applications such as in metal finishing applications, for example, the uniform destruction of the capsules during use provides continuous release of lubricant and continued lubricity without the need for additional lubricant from other sources. Further, the abrasive articles of the invention exhibit excellent abrasive power over the duration of time during which the article is being used.

Although a preferred embodiment of the invention has been described, it will be appreciated that changes and modifications to the described embodiment may be made by those skilled in the art without departing from the spirit and the scope of the invention, as defined in the claims.

We claim:

1. An abrasive article, comprising:

a base substrate comprising a plurality of polymeric fibers adhered to one another at mutual contact point, said substrate having a base weight within the range from 20 to 10,000 g/m$^2$;

abrasive grains adhered to said substrate; and a plurality of capsules comprising a continuous shell containing lubricant therein, said shell comprising a cured thermosetting resin, the capsules dispersed throughout the substrate and adhered to the fibers.

2. The abrasive article according to claim 1, wherein said fibers are staple fibers having a length within the range from about 10 to 50 mm and a denier within the range from about 5 to 30.

3. The abrasive article according to claim 2, wherein said fibers comprise materials selected from the group consisting of polyamide, polyester, polypropylene, polyethylene, polysulfone, acrylic, poly (vinyl chloride) and combinations of any of the foregoing materials.

4. The abrasive article according to claim 3, wherein said polyamide is nylon 6,6.

5. The abrasive article according to claim 1, wherein said substrate has a void volume within the range from about 40 to 99%.

6. The abrasive article according to claim 1, wherein said abrasive grains comprise materials selected from the group consisting of silicon carbide, aluminum oxide, chromium oxide, emery and flint.

7. The abrasive article according to claim 6, wherein said abrasive grains have an average grain size within the range from about 0.6 to 500 μm.

8. The abrasive article according to claim 1, wherein said abrasive grains are present within the articles in an amount within the range from about 10 to 1000 parts by weight per 100 parts by weight of said substrate.

9. The abrasive article according to claim 1, wherein said capsules comprise a thermosetting resin selected from the group consisting of epoxy resin, urea resin, melamine resin, phenol resin and polyamide resin.

10. The abrasive article according to claim 9, wherein said urea resin is selected from the group consisting of urea-formaldehyde resin, urea-acetaldehyde resin, urea-propionaldehyde resin, and urea-butylaldehyde resin.

11. The abrasive article according to claim 9, wherein said melamine resin is selected from the group consisting of melamine-formaldehyde resin, melamine-acetaldehyde resin, melamine-propionaldehyde resin and melamine-butylaldehyde resin.

12. The abrasive article according to claim 9, wherein said phenol resin is selected from the group consisting of phenol-formaldehyde resin, phenol-acetaldehyde resin, phenol-propionaldehyde resin, phenol-butylaldehyde resin, xylenol-formaldehyde resin, xylenol-acetaldehyde resin, xylenol-propionaldehyde resin and xylenol-butylaldehyde resin.

13. The abrasive article according to claim 1, wherein said resin is a crosslinked urea resin comprising the reaction product of urea and a crosslinking agent at a molar ratio of urea to said crosslinking agent within the range 1:1.2 to 1:1.7.

14. The abrasive article according to claim 1, wherein said resin has a glass transition temperature of at least about 160° C.

15. The abrasive article according to claim 1, wherein said lubricant is selected from the group consisting of paraffin wax, silicone oil, olefin polymerized oil, diester oil, polyoxyalkylene glycol, and halogenated hydrocarbon oil and fatty acids.

16. The abrasive article according to claim 1, further comprising a film surrounding said resin, said film consisting of a metal or metallic oxide of nickel, copper, zinc, silver, lead or tin.

17. The abrasive article according to claim 1 wherein said capsules are of a size within the range from about 5 to 300 μm.

18. The abrasive article according to claim 1 wherein said shell has a thickness within the range from about 0.5 to 20 μm.

19. A composite abrasive article comprising at least two layers of the non-woven abrasive article of claim 1 compressed together and adhered by a binder, the composite article having a flexural modulus of not more than 1,000 kgf/cm$^2$.

* * * * *